US009795934B2

(12) United States Patent
Connors

(10) Patent No.: US 9,795,934 B2
(45) Date of Patent: Oct. 24, 2017

(54) WINE AND SPIRITS AERATOR

(71) Applicant: Robert W. Connors, Lake Barrington, IL (US)

(72) Inventor: Robert W. Connors, Lake Barrington, IL (US)

( * ) Notice: Subject to any disclaimer, the term of this patent is extended or adjusted under 35 U.S.C. 154(b) by 0 days.

(21) Appl. No.: 14/992,617

(22) Filed: Jan. 11, 2016

(65) Prior Publication Data

US 2016/0199794 A1 Jul. 14, 2016

Related U.S. Application Data

(60) Provisional application No. 62/102,295, filed on Jan. 12, 2015.

(51) Int. Cl.
*B01F 3/04* (2006.01)

(52) U.S. Cl.
CPC ..... *B01F 3/04794* (2013.01); *B01F 3/04262* (2013.01); *B01F 2003/0439* (2013.01); *B01F 2003/04319* (2013.01); *B01F 2215/0072* (2013.01)

(58) Field of Classification Search
CPC ..... B01F 3/04794; B01F 15/026; B01F 3/04262; B01F 2003/04319; B01F 2003/0439; B01F 2215/0072
USPC ..... 261/122.1, 122.2, 124, 76
See application file for complete search history.

(56) References Cited

U.S. PATENT DOCUMENTS

| | | | | |
|---|---|---|---|---|
| 2,408,306 A * | 9/1946 | Flournoy | A01K 63/042 261/121.2 |
| 2,680,010 A | 6/1954 | Dubay | |
| 4,115,500 A | 9/1978 | Voegeu | |
| 4,494,452 A | 1/1985 | Barzso | |
| 4,610,282 A | 9/1986 | Brooks et al. | |
| 5,154,112 A * | 10/1992 | Wettern | B01F 3/04794 215/228 |
| 5,595,104 A * | 1/1997 | Delaplaine | B01F 3/04794 261/124 |

(Continued)

FOREIGN PATENT DOCUMENTS

| | | |
|---|---|---|
| DE | 29604406 | 10/1996 |
| EP | 2279786 | 2/2011 |

(Continued)

OTHER PUBLICATIONS

VineWineAccessoris.com, Wine-Stone Wine Aerator, http://www.vinewineaccessories.corn/product/CCF-7728, Accessed Dec. 14, 2015—6 pages.

(Continued)

*Primary Examiner* — Charles Bushey
(74) *Attorney, Agent, or Firm* — K&L Gates LLP

(57) ABSTRACT

A liquid aerator in one embodiment includes an air deliverer having a bulb pump portion formed integrally with a stem portion; a one-way valve located in the bulb pump portion of the air deliverer; and a porous diffuser located at a distal end of the stem portion of the air deliverer. A liquid aerator in another embodiment includes an air deliverer having a bottle shape including a larger diameter base portion formed integrally with a narrower diameter neck portion; a one-way valve located in the base portion of the air deliverer; and a porous diffuser located at a distal end of the neck portion of the air deliverer.

21 Claims, 7 Drawing Sheets

(56) References Cited

U.S. PATENT DOCUMENTS

| | | | | |
|---|---|---|---|---|
| 6,014,832 | A | 1/2000 | Brooks | |
| 6,202,991 | B1 | 3/2001 | Coniglio et al. | |
| 6,371,332 | B1 * | 4/2002 | Fox | A45D 27/12 222/190 |
| 6,508,163 | B1 | 1/2003 | Weatherill | |
| 6,666,967 | B1 | 12/2003 | Oyabu | |
| 7,850,365 | B1 | 12/2010 | Much et al. | |
| 8,011,540 | B1 | 9/2011 | Peckels | |
| 8,413,858 | B2 | 4/2013 | Rasmussen et al. | |
| 8,430,023 | B2 | 4/2013 | Hynes | |
| 8,485,503 | B2 | 7/2013 | Lei | |
| 8,517,350 | B2 | 8/2013 | Tsai et al. | |
| 8,561,970 | B1 | 10/2013 | Mills et al. | |
| 8,567,305 | B2 * | 10/2013 | Bregman | B01F 3/04262 261/122.1 |
| D732,890 | S * | 6/2015 | Connors | D7/397 |
| 9,168,495 | B2 * | 10/2015 | Connors | B01F 3/04262 |
| 9,321,018 | B2 * | 4/2016 | Connors | B01F 3/04241 |
| 9,321,019 | B2 * | 4/2016 | Stevenson | |
| 2002/0053577 | A1 | 5/2002 | Maas et al. | |
| 2005/0205609 | A1 | 9/2005 | Moore | |
| 2006/0032855 | A1 | 2/2006 | Hinkle | |
| 2006/0172041 | A1 | 8/2006 | Farrell | |
| 2006/0188617 | A1 | 8/2006 | Farrell et al. | |
| 2007/0187848 | A1 | 8/2007 | Sabadicci et al. | |
| 2007/0210109 | A1 | 9/2007 | Wiemholt | |
| 2007/0256568 | A1 | 11/2007 | Nudi et al. | |
| 2008/0219092 | A1 | 9/2008 | Clement | |
| 2008/0290102 | A1 | 11/2008 | Mangano | |
| 2009/0160072 | A1 | 6/2009 | Chiorazzi | |
| 2009/0181144 | A1 | 7/2009 | Farrell | |
| 2009/0212053 | A1 | 8/2009 | Lardino | |
| 2010/0006603 | A1 | 1/2010 | Weinberg et al. | |
| 2010/0011967 | A1 | 1/2010 | Barberio et al. | |
| 2010/0025867 | A1 | 2/2010 | Benton et al. | |
| 2010/0058933 | A1 | 3/2010 | Cheng | |
| 2010/0072637 | A1 | 3/2010 | Sabadicci et al. | |
| 2010/0090355 | A1 | 4/2010 | Weatherill | |
| 2010/0091605 | A1 | 4/2010 | Rasmussen et al. | |
| 2010/0122919 | A1 | 5/2010 | Burroughs et al. | |
| 2011/0024461 | A1 | 2/2011 | Kilduff et al. | |
| 2011/0024925 | A1 | 2/2011 | Mauffette | |
| 2011/0042835 | A1 | 2/2011 | Sabadicci et al. | |
| 2011/0127281 | A1 | 6/2011 | Mitchell | |
| 2011/0154994 | A1 | 6/2011 | Sabadicci | |
| 2011/0204093 | A1 | 8/2011 | Lee | |
| 2011/0268838 | A1 | 11/2011 | Vondrasek et al. | |
| 2011/0271846 | A1 | 11/2011 | Hynes | |
| 2011/0274805 | A1 | 11/2011 | Nudi, Jr. et al. | |
| 2011/0297001 | A1 | 12/2011 | DeJohn | |
| 2011/0297006 | A1 * | 12/2011 | Belcher | B01F 3/04262 99/323.1 |
| 2012/0012718 | A1 | 1/2012 | Tiso | |
| 2012/0074092 | A1 | 3/2012 | Devoy et al. | |
| 2012/0074172 | A1 | 3/2012 | Federighi | |
| 2012/0111153 | A1 | 5/2012 | Ward | |
| 2012/0111202 | A1 | 5/2012 | Bregman | |
| 2012/0111893 | A1 | 5/2012 | Luebke | |
| 2012/0156338 | A1 | 6/2012 | Agarwal et al. | |
| 2012/0156345 | A1 | 6/2012 | Agarwal et al. | |
| 2012/0164290 | A1 | 6/2012 | Gerrits | |
| 2012/0164300 | A1 | 6/2012 | Niazi | |
| 2012/0167775 | A1 | 7/2012 | Burroughs et al. | |
| 2012/0199013 | A1 | 8/2012 | Gutierrez | |
| 2012/0201942 | A1 | 8/2012 | Kilduff et al. | |
| 2012/0261844 | A1 | 10/2012 | Lei | |
| 2012/0269945 | A1 | 10/2012 | Wijnen et al. | |
| 2012/0272831 | A1 | 11/2012 | Barberio et al. | |
| 2012/0280410 | A1 | 11/2012 | Hardison | |
| 2013/0099398 | A1 | 4/2013 | Takase et al. | |
| 2013/0122161 | A1 | 5/2013 | Cole et al. | |
| 2013/0140721 | A1 | 6/2013 | Borden et al. | |
| 2013/0153685 | A1 | 6/2013 | Michael J. et al. | |
| 2013/0202757 | A1 | 8/2013 | Hawkins | |
| 2013/0207284 | A1 | 8/2013 | Heyman et al. | |
| 2013/0292857 | A1 * | 11/2013 | Connors | B01F 3/04241 261/30 |
| 2014/0035172 | A1 * | 2/2014 | Connors | B01F 3/04262 261/30 |
| 2016/0236159 | A1 * | 8/2016 | Connors | B01F 3/04241 |

FOREIGN PATENT DOCUMENTS

| | | |
|---|---|---|
| GB | 712325 | 7/1954 |
| WO | 8906159 | 7/1989 |
| WO | 0018499 | 4/2000 |

OTHER PUBLICATIONS

Prodyne, Wine Wandtm Automatic Wine Aerator; http://www.prodyne.com/index.php/catalog/item/24-corkscrews-wine-openers-wine-accessory-sets/11-ww-4, Accessed Dec. 14, 2015—6 pages.

Direct Shopping Center: Wine Stone—Wine Aerator, http://www.directshoppingcenter.com/Wine-Stone-Wine-Aerator-p/fr-7728.htm?utm_sour . . . Aug. 12, 2015—4 pages.

European Office Action Application No. 13 724 934.8-1703 dated Jun. 8, 2016—7 pages.

Chinese Office Action Application No. 2014031010009030 dated Mar. 13, 2014—1 page.

* cited by examiner 10a
50
22
20
24
44mm
OD
12
26
32
30
42
34
44
40
Bulb has a non-circular cross-section
22
20
38mm
44mm
26
32
Bulb and Stem formed in one mold
30

100
Seal along sides and top
106
102
104
100
10a, 10b cardboard backing
100
102
104
clear plastic shell
indent on both sides snaps stem into place, keeps Mini from shifting
50
travel bag stored at bottom
Seal along bottom
10a, 10b

WINE AND SPIRITS AERATOR

PRIORITY CLAIM

This application claims priority to and the benefit of U.S. Provisional Patent Application No. 62/102,295, filed Jan. 12, 2015, entitled, Wine And Spirits Aerator, the entire contents of which are hereby incorporated by reference and relied upon.

BACKGROUND

The present disclosure relates generally to gas in liquid diffusion, and in particular to the aeration of wine and spirits.

Whether a bottle of wine is expensive or not, people want their wine to taste good. It is known to aerate wine, or to let it breathe, before drinking the wine. And it is generally understood that just about any wine will benefit from proper aeration. One problem with attempting to let wine, especially certain red wines, breathe is that the process takes time. In a social setting, for example at a home party or celebration, wine bottles may be opened at a pace that is not conducive to letting bottles sit open for extended amounts of time. In a restaurant setting, a similar problem may occur when there may simply be too many different bottles to be opened to maintain a primary set of bottles for pouring and a secondary set of bottles that are breathing, or being readied for pouring. The result is that more often than not, wine is not properly aerated before it is consumed.

Improved apparatuses and methods for aerating wine and for preparing carbonated beverages are needed accordingly.

SUMMARY

The present disclosure in one primary aspect provides devices or apparatuses for aerating wine and spirits, that is, actively oxygenating the wine or spirits before they are consumed. The apparatuses are portable, light weight, and cost effective. The devices can aerate a glass of wine in a very short period of time, for example, on the order of seconds. The devices can aerate both red and white wine very effectively. The devices are not limited to the effective aeration of wine but may also effectively aerate any liquid containing tannins, such as liquids aged in a wood or oak barrel. For example, spirits such as bourbon, brandy, cognac, gin, liqueur, rum, scotch, tequila, whiskey and other liquids aged in wooden or oak barrels and are easily and effectively aerated by the devices of the present disclosure.

The aerator includes an air delivery device. The air delivery device includes a bulb pump portion and a stem portion. In one embodiment, the bulb pump and stem portions are molded together as one continuous piece. Such construction enables the majority of the aerator to be made of a relatively inexpensive rubber or plastic. The bulb pump portion may be oblong in cross-section or be substantially spherical in cross-section. Being oblong in cross-section is advantageous in one respect because the unit or aerator will stop rolling quicker when placed on a table and provides a ready squeezing surface. The air delivery device may further alternatively be bottle-shaped, e.g., wine bottle-shaped, and be able to stand on its base end like a wine bottle.

The bulb pump portion is sized so that one, two or three squeezes of the aerator is/are sufficient to aerate a glass of wine or spirit in a very short amount of time. A certain type of wine or spirit may only require a single squeeze for proper aeration. Other types of wine or spirits may require more than one squeeze of the bulb portion. The bulb pump portion is accordingly sized to accommodate all types of wines and spirits.

The bulb pump portion accepts a one-way valve at its rear end. The one-way or check valve allows air into the bulb pump portion when the bulb pump portion is expanding after being squeezed. The negative pressure caused by the expansion opens a flap of the one-way valve, allowing air into the bulb pump portion as it expands. The flap of the one-way valve closes once the bulb portion is done filling with air. When the user squeezes the bulb pump portion, the pressure seals the flap closed tightly, forcing air out of a diffuser.

The distal end of the stem portion is connected or sealed to the diffuser. The diffuser is in one embodiment a perforated, sintered or porous structure that receives air from the distal end of the stem portion and disperses the air in multiple directions, e.g., in a plume-like manner, into the wine. In one embodiment, the diffuser is a metal or stainless steel (e.g., type 304 or 316 stainless steel) porous or sintered metal cup, whose pores or openings may be less than one-hundred microns in average diameter, e.g., ten, five, two, or less than one micron. In another embodiment, the diffuser is an air stone used typically with fish tanks to introduce or infuse air into the tank water. The material for the air stone diffuser may be a lightweight wood, plastic, composite or cork material. In a further alternative embodiment, the material for the diffuser is a porous plastic, e.g., a food grade plastic.

Any of the diffuser materials may be continuous and formed with the perforations or pores or be made of multiple plies to have the perforations or pores. The perforations or pores are also small enough in one embodiment, such that the forcing of air through the diffuser causes the air bubbles entering the wine to be very small, e.g., to be microbubbles. The small bubbles diffuse much more easily and effectively into the wine. The perforations or pores may also be small enough such that wine or liquid does not enter the diffuser when the tube and diffuser are placed into the wine or liquid. The hydrophobic nature of the diffuser keeps liquid from entering the diffuser and allows air to be located within the diffuser when the pump is actuated, which helps to deliver air smoothly into the wine.

In an embodiment, the aerator is placed in a protective bag, such as a nylon bag for transport. The bag may be of a closed weave in an effort to keep dust and debris from contacting the air deliverer. Alternatively, the bag may be of an open mesh, so that air may enter the bag to dry the diffuser between uses. The bag transports the aerator between uses, preventing the diffuser, if still wet from use, from contacting an outside surface undesirably.

In light of the present description and drawings, and without limiting the invention in any way, in a first aspect, the present disclosure includes a liquid aerator including an air deliverer having a bulb pump portion formed integrally with a stem portion; a one-way valve located in the bulb pump portion of the air deliverer; and a porous diffuser located at a distal end of the stem portion of the air deliverer.

In a second aspect, which may be used in combination with any other aspect listed herein unless specified otherwise, the diffuser is removeably connected to the distal end of the stem portion of the air deliverer.

In a third aspect, which may be used in combination with any other aspect listed herein unless specified otherwise, the bulb pump portion and the stem portion are molded as one piece.

In a fourth aspect, which may be used with any other aspect listed herein unless specified otherwise, the diffuser has a pore size of one-hundred microns or less.

In a fifth aspect, which may be used with any other aspect listed herein unless specified otherwise, the distal end of the stem portion of the air deliverer seals onto the porous diffuser.

In a sixth aspect, which may be used in combination with any other aspect listed herein unless specified otherwise, the stem portion is tapered.

In a seventh aspect, which may be used in combination with any other aspect listed herein unless specified otherwise, the stem portion is at least substantially cylindrical.

In an eighth aspect, which may be used in combination with any other aspect listed herein unless specified otherwise, the air deliverer is rubber or plastic.

In a ninth aspect, which may be used in combination with any other aspect listed herein unless specified otherwise, the diffuser is sintered metal.

In a tenth aspect, which may be used with any other aspect listed herein unless specified otherwise, the diffuser is cylindrical and the distal of the stem portion stretches around an open end of the cylindrical diffuser to seal to the diffuser.

In an eleventh aspect, which may be used with the ninth aspect in combination with and any other aspect listed herein unless specified otherwise, the bulb portion of the air deliverer is oblong.

In a twelfth aspect, which may be used in combination with any other aspect listed herein unless specified otherwise, the bulb portion of the air deliverer is at least substantially circular.

In a thirteenth aspect, which may be used in combination with any other aspect listed herein unless specified otherwise, the bulb portion of the air deliverer is cylindrical and has a diameter that is larger than a diameter of the stem portion.

In a fourteenth aspect, which may be used in combination with any other aspect listed herein unless specified otherwise, the bulb portion of the air deliverer has an end configured to enable the liquid aerator to be set on and supported by the end so that the stem portion extends upwardly without additional support.

In a fifteenth aspect, which may be used in combination with any other aspect listed herein unless specified otherwise, the inner diameter of the distal end of the stem portion of the air deliverer defines a step against which the diffuser is abutted when fully inserted into the distal end.

In a sixteenth, which may be used with the fifteenth aspect in combination with any other aspect listed herein unless specified otherwise, the inner diameter of the distal end of the stem portion of the air deliverer is smaller than an outer diameter of the diffuser.

In a seventeenth aspect, which may be used in combination with any other aspect listed herein unless specified otherwise, a liquid aerator includes an air deliverer having a bottle shape including a larger diameter base portion formed integrally with a narrower diameter neck portion; a one-way valve located in the base portion of the air deliverer; and a porous diffuser located at a distal end of the neck portion of the air deliverer. The base portion of the bottle-shaped air deliverer may have an end configured to enable the liquid aerator to be set on and supported by the end so that that the neck portion extends upwardly without additional support. The base portion and the neck portion may be molded as one piece. The air deliverer may be rubber or plastic.

In additional aspects, any of the structure and functionality discussed in connection with FIGS. 1A to 10 may be used in combination with any other aspect or combination of aspects discussed herein unless specified otherwise.

In light of above and the following detailed description, it is an advantage of the present disclosure to provide a wine or spirits aerator or breathing apparatus that is effective to aerate wine and spirits in a short period of time.

It is another advantage of the present disclosure to provide a wine or spirits aerator or breathing apparatus that is cost effective.

It is a further advantage of the present disclosure to provide a wine or spirits aerator or breathing apparatus that is lightweight.

It is yet a further advantage of the present disclosure to provide a wine or spirits aerator or breathing apparatus that is manually powered such that the apparatus is highly portable and does not require power.

Moreover, it is an advantage of the present disclosure to provide an aerator that may aerate red wines, white wines, and any spirit containing tannins or aged in a barrel.

Additional features and advantages are described herein, and will be apparent from, the following Detailed Description and the figures.

DETAILED DESCRIPTION

Figures 1A, 1B, 1C, 2:
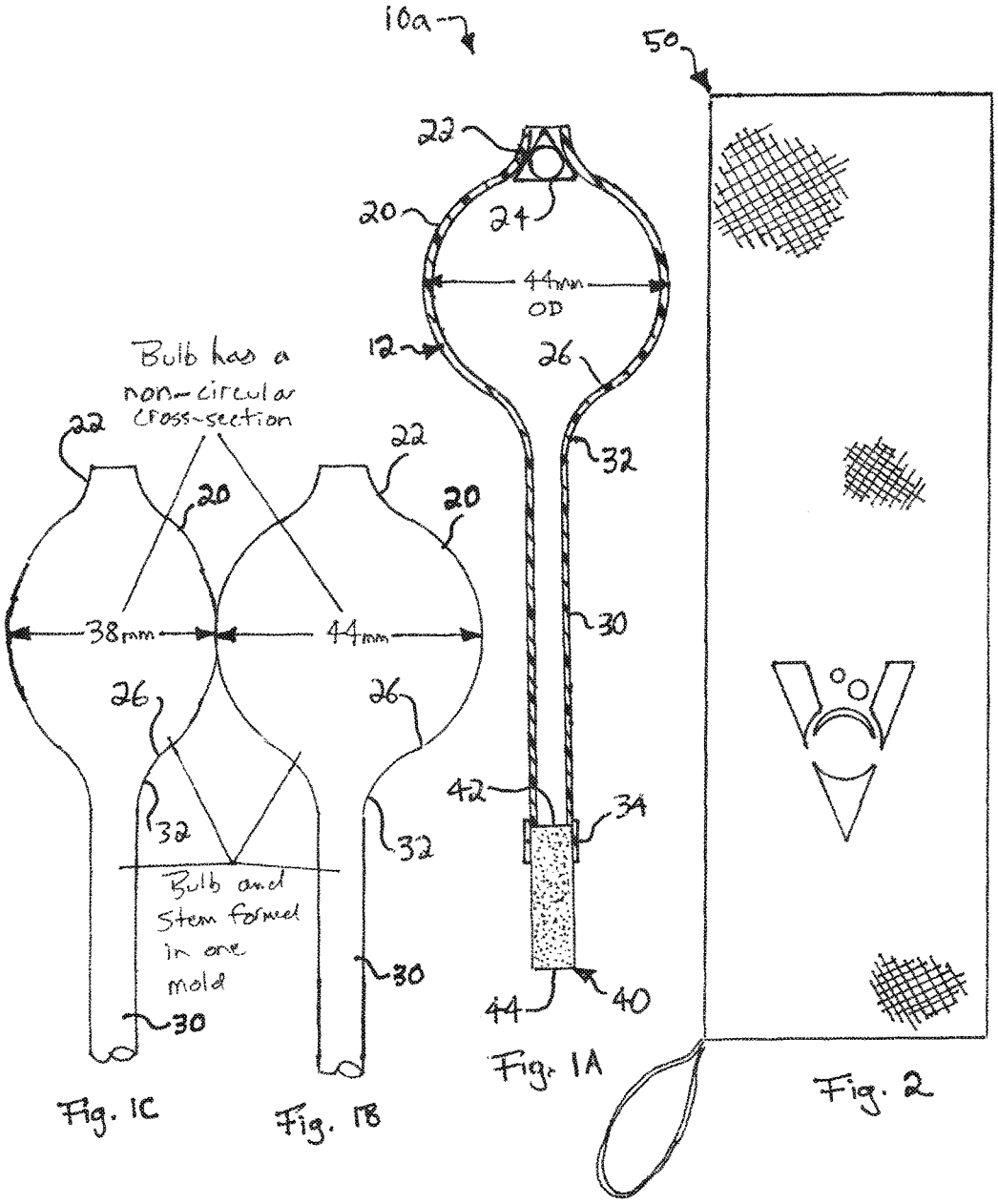
FIG. 1A is a front elevation view of one embodiment for a wine and spirits aerator of the present disclosure.
FIGS. 1B and 1C are front and side elevation views, respectively, of a bulb pump portion of an air deliverer of the aerator of FIG. 1A, showing an embodiment of the bulb pump portion having an oblong shape.
FIG. 2 is a front elevation view of one embodiment for a protective bag for the aerators described herein.

Referring now to the drawings and in particular to FIGS. 1A to 1C, various implementations of one primary embodiment for a wine aerator or breathing apparatus of the present disclosure are illustrated by aerator 10*a*. Aerator 10*a* includes an air deliverer 12 sealingly connected to a diffuser 40. To reduce cost, or to make a lower cost version, it may be desirable to make air deliverer 12 out of plastic or rubber. Suitable plastics for tubing 12 include polyvinyl chloride ("PVC"), high density polyvinyl chloride ("HDPVC"), low density polyvinyl chloride ("LDPVC"), ultra-high density polyvinyl chloride ("UHDPVC"), polyethylene, polypropylene, nylon, polyester and polystyrene. Plastic air deliverer 12 may be clear, semi-clear, or colored, such as translucent, for example. Suitable rubbers for tubing 12 include buna-N, butyl, neoprene, silicone, vinyl and viton. Rubber air deliverer 12 may be clear, semi-clear, or colored, such as translucent, for example. In an embodiment, rubber or plastic air deliverer 12 may be made stiff enough that it does not bend under its own weight, e.g., if held by the diffuser 40, the weight of bulb pump portion 20 will not cause a stem portion 30 of diffuser 40 to bend.

Bulb pump portion 20 at its rear end 22 includes a one-way valve 24. One-way or check valve 24 allows air into bulb pump portion 20 when bulb pump portion 20 is expanding after being squeezed. A negative pressure caused by the expansion opens a flap (not illustrated) of one-way valve 24, allowing air into the bulb pump portion 20 as it expands. The flap of one-way valve 24 closes once bulb pump portion 20 is done filling with air. When the user squeezes the bulb pump portion, the pressure seals the flap closed tightly, forcing air out of diffuser 40.

In an embodiment, bulb pump portion 20 of air deliverer 12 at its rear end 22 is molded to define a hole that accepts one-way valve 24, e.g., press-fittingly or adhesively. The hole may be expanded so that an inner molding tool may be pulled from bulb pump portion 20 and stem portion 30 of air deliverer 12 without tearing either bulb pump portion 20 or stem portion 30.

Bulb pump portion 20 of air deliverer 12 at its front end 26 transitions to neck 32 of stem portion 30, which in an embodiment is a smooth radius transition. Stem 30 may be a hollow cylinder having an at least substantially constant diameter from its proximal end 32 to its distal end 34 as illustrated in FIGS. 1A to 1C, 5A and 5B. Stem 30 may alternatively be tapered, e.g., narrowed from its proximal end 32 to its distal end 34 as illustrated below in FIGS. 3A and 3B.

Diffuser 40 may be removeably press-fitted into, press-fitted onto, threaded onto, threaded into, compression fitted to, adhered to, and/or formed integrally with or permanently attached to distal end 34 of stem portion 30 of air deliverer 12. In the illustrated embodiment of FIG. 1, distal end 34 of stem portion 30 of air deliverer 12 is sealingly stretched to fit around an open end 42 of diffuser 40. The distal end 44 of diffuser 40 is closed with porous material. Diffuser in one embodiment is at least substantially cylindrical and includes an outer diameter that is greater than an inner diameter of distal end 34 of stem portion 30. Thus, the distal end 34 of stem portion 30 has to stretch and thereby seal to open end 42 of diffuser to be connected removeably to same.

Diffuser 40 in one embodiment is made of a sintered, porous or perforated material. Diffuser 40 may be layered to have or formed to have small diffusing holes, openings or apertures. Diffuser 40 may alternatively be of a polymer material, wood, cork, rubber, metal or combinations thereof. Diffuser 40 may be plastic and be formed with, e.g., injection molded with stem portion of 30 of air deliverer 12. Diffuser 40 may be an air stone. The air stone may be one used to deliver air into water, typically used for fish tanks. Diffuser 40 causes the air delivered through stem portion 30 to diffuser 40 to be separated into small bubbles, such as microbubbles, when delivered to the wine. The small bubbles help the air to mix with and diffuse into the wine as opposed to simply migrating to the top of the glass, without mixing.

In one embodiment, diffuser 40 is a stainless steel (e.g., type 304 or 316 stainless steel) porous cup or porous capped tube segment. The pore size may, for example, be less than one-hundred microns, such as ten microns, five microns, two microns, one micron or less than one micron, such as a half-micron or fraction of a micron. Smaller pore sizes make smaller air bubbles, which helps the air to diffuse into the wine. Diffuser 40 is in one embodiment generally impermeable to liquids. That is, diffuser 40 is generally hydrophobic and will not allow wine or liquids to enter. Air will thus be present in diffuser 40, stem portion 30 and bulb pump portion 20 when the bulb pump portion is actuated.

Diffuser 40 as illustrated in FIG. 1 is a cylindrical cup in one embodiment with an open end 42 and a capped end 44. Open end 42 allows air to be pumped into a cylindrical cavity located within diffuser 40 before being broken into tiny microbubbles by the porous walls of the diffuser.

Bulb pump portion 20 of air deliverer 12 in the illustrated embodiment has a bulb shape. The bulb shape may be rounder, like a tennis ball or flatter, like an American football or rugby ball. In the embodiment illustrated in FIGS. 1B and 1C, bulb pump portion 20 has an oblong cross-sectional area. FIGS. 1A and 1B illustrate bulb pump portion 20 from the front, which is at least substantially circular. FIG. 1B gives one example diameter of 44 millimeters ("mm"). FIG. 1C illustrates bulb pump portion 20 from the side, which is oblong or elliptical. FIG. 1C gives an example largest diameter of 38 mm. If bulb pump portion 20 is viewed from the top, it will therefore have an oblong or elliptical cross-section. The oblong shape of bulb pump portion 20 is helpful because it provides a flatter, comfortable squeezing surface. The oblong shape of bulb pump portion 20 is also helpful because it helps to prevent bulb pump portion 20 from rolling around a surface on which it is set.

FIG. 2 illustrates one embodiment of a protective bag 50 for holding aerators 10*a* and 10*b*. Bag 50 may be made of a protective, cloth-like material, such as nylon. The nylon may be made of a closed weave that provides maximum protection against dirt and dust getting into bag 50 and from a moist diffuser 20 contacting an outside material. In an alternative embodiment, bag 50 is made of an open mesh, so that air may pass through the bag to dry diffuser 20 between uses.

Figures 3A, 3B:
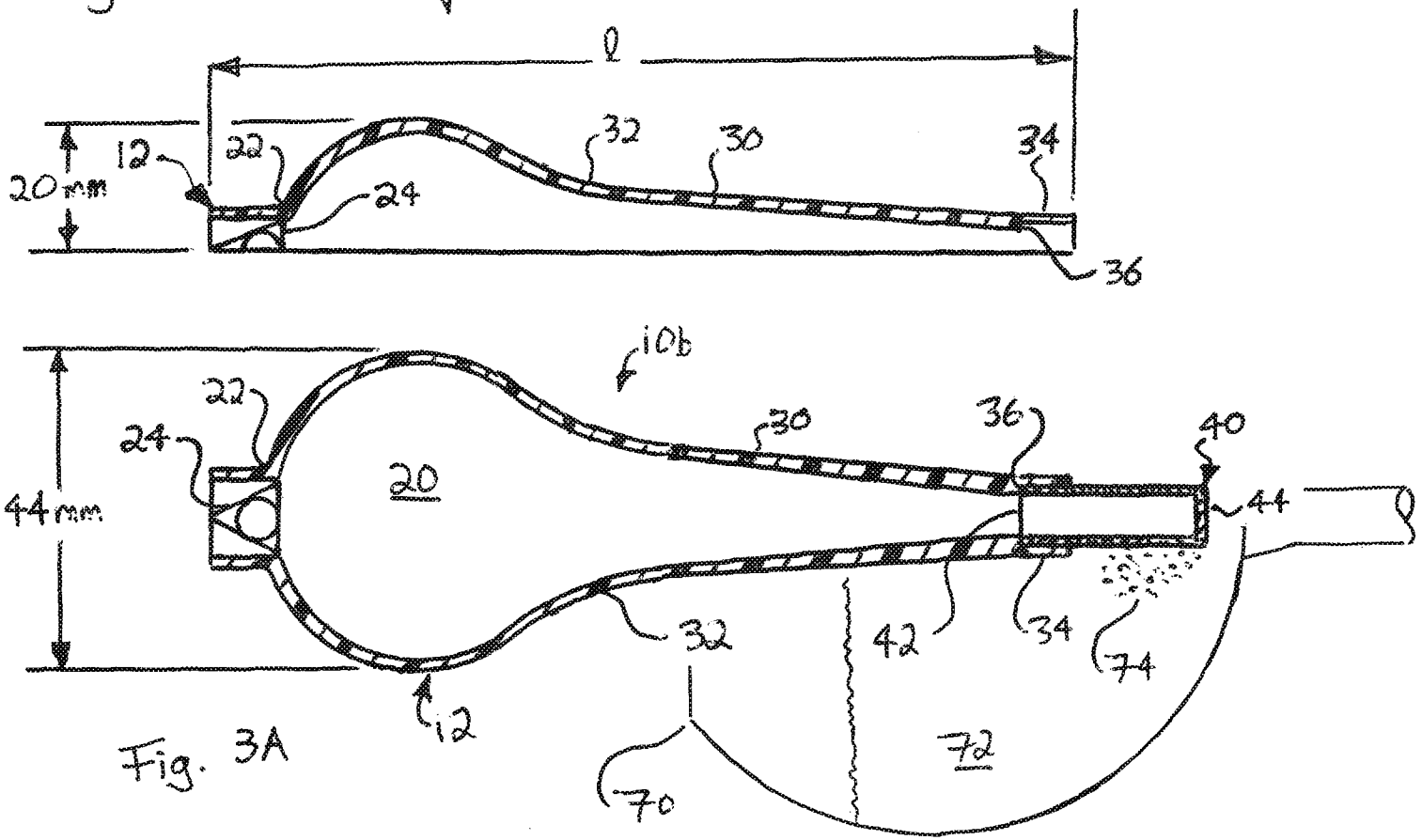
FIG. 3A illustrates a cross-sectional view of another embodiment for a wine and spirits aerator of the present disclosure.
FIG. 3B illustrates a partial cross-sectional view of the wine and spirits aerator of FIG. 3A rotated 90°.

FIGS. 3A and 3B illustrate an alternative aerator 10*b*. Aerator 10*b* is similar to aerator 10*a* in many respects and may be made of any of the materials, structures and alternatives described above for aerator 10*a*. One difference is that stem portion 30 tapers inwardly from proximal end 32 to distal end 34. The taper helps to stiffen stem portion 30. Bulb pump portion 20 of aerator 10*b* is oblong just like that of aerator 10*a*. Here, the diameter of front view is again 44 mm, while the largest diameter of the side view is 20 mm. Thus, if bulb pump portion 20 is looked at from the top view, the shape is again oblong. In an alternative embodiment, bulb pump portion 20 is at least substantially spherical.

FIG. 3A shows aerator 10*b* with diffuser 40 in place, while FIG. 3B shows the diffuser removed. Both FIGS. 3A and 3B illustrate that distal end 34 of stem portion 30 is molded with, includes, or defines an internal step 36 that stops open end 42 of diffuser 40 at a desired location when diffuser 40 is inserted into distal end 34 of stem portion 30. That is, open end 42 of diffuser 40 abuts up against step 36 when diffuser 40 is fully inserted into distal end 34 of stem portion 30.

FIG. 3A illustrates a portion of a wine glass 70, holding wine 74 to give some idea of the size and use of aerators 10*a* and 10*b*. The length l in FIG. 3B of air deliverer 12 may be 120 mm, for example. FIG. 3A illustrates microbubbles 74 being squeezed from diffuser 40 into wine 72 to aerate same.

Figures 4, 5A, 5B:
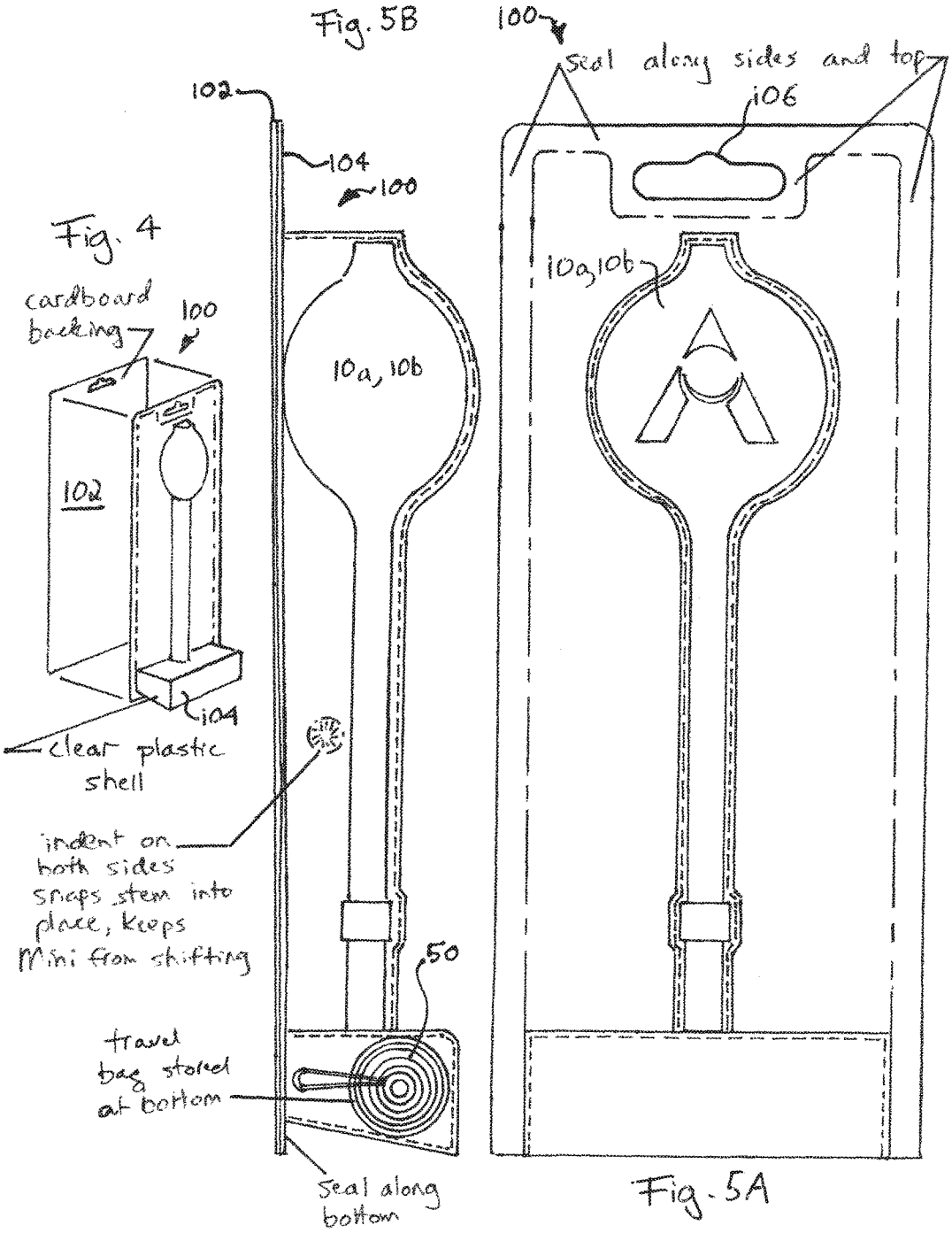
FIG. 4 is a perspective view of one embodiment for the packaging of the present disclosure.
FIGS. 5A and 5B are front and side views, respectively, of one of the aerators of the present disclosure located in its packaging.

FIG. 4 illustrates one embodiment for a package 100 for aerators 10*a* and 10*b* of the present disclosure. Package 100 in the illustrated embodiment includes a cardboard backing 102 and a blister or clear plastic front 104. When sealed together, backing 102 and front 104 may be hung from a peg hook via a sombrero opening 106 (FIG. 5A), or be stood on its own on a shelf, for example. FIGS. 5A and 5B illustrate package 100 with aerator 10*a* (or 10*b*) placed therein. The bottom of blister or clear plastic front 104 holds protective bag 50 and also provides the base upon which package 100 may sit. Package 100 may be used for aerator 10*c* described below, however, the wine bottle aerator 10*c* would be rotated ninety degrees in package 100, so that diffuser 40 points upwardly instead of downwardly as is illustrated for aerators 10*a* and 10*b*.

Referring now to FIGS. 6 to 10, another primary embodiment for a wine aerator or breathing apparatus of the present disclosure is illustrated by aerator 10*c*. Aerator 10*c* includes a bottle-shaped or wine bottle-shaped air deliverer 112 sealingly connected to a diffuser 40. Bottle-shaped air deliverer 112 may be made of any of the plastics or rubbers discussed above for aerators 10*a* and 10*b*. In an embodiment, rubber or plastic bottle-shaped air deliverer 112 may be made stiff enough that it does not bend under its own weight, e.g., if held by the diffuser 40, the weight of base pump portion 120 will not cause a neck portion 130 of diffuser 40 to bend. Diffuser 40 may be made of any of the materials and have any of the alternatives discussed above, including any of the sizes and pore sizes.

Base pump portion 120 at its rear end 122 again includes a one-way valve 24. One-way or check valve 24 allows air into base portion 120 when base portion 120 is expanding after being squeezed. A negative pressure caused by the expansion opens a flap (not illustrated) of one-way valve 24, allowing air into the base portion 120 as it expands. The flap of one-way valve 24 closes once base portion 120 is done filling with air. When the user squeezes the base pump portion 120, the pressure seals the flap closed tightly, forcing air out of diffuser 40.

In an embodiment, base portion 120 of bottle-shaped air deliverer 112 at its rear end 122 is molded to define a hole that accepts one-way valve 24, e.g., press-fittingly or adhesively. The hole may be expanded so that an inner molding tool may be pulled from base portion 120 and neck portion 130 of air deliverer 112 without tearing either base portion 120 or stem portion 130. Rear end 122 of base portion 120 may be relatively flat so that aerator 10*c* may be set on and supported by rear end 122 of base portion 120, allowing neck portion 130 and diffuser 40 to extend upwardly without further support structure, like the placement and support of a wine bottle.

Figure 6:
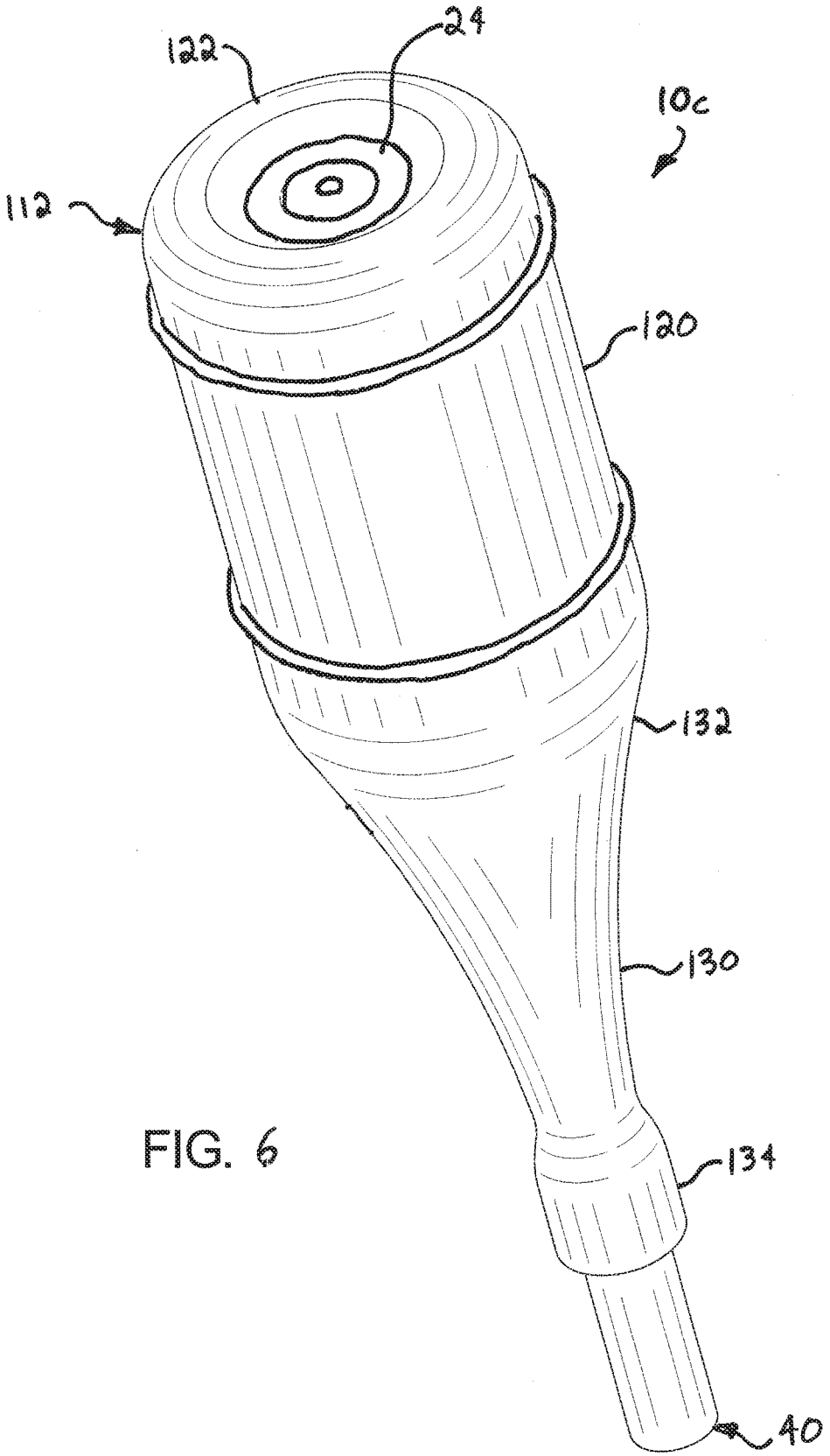
FIG. 6 is a bottom, front perspective view of another embodiment of a wine and spirits aerator of the present disclosure.
Figure 7:
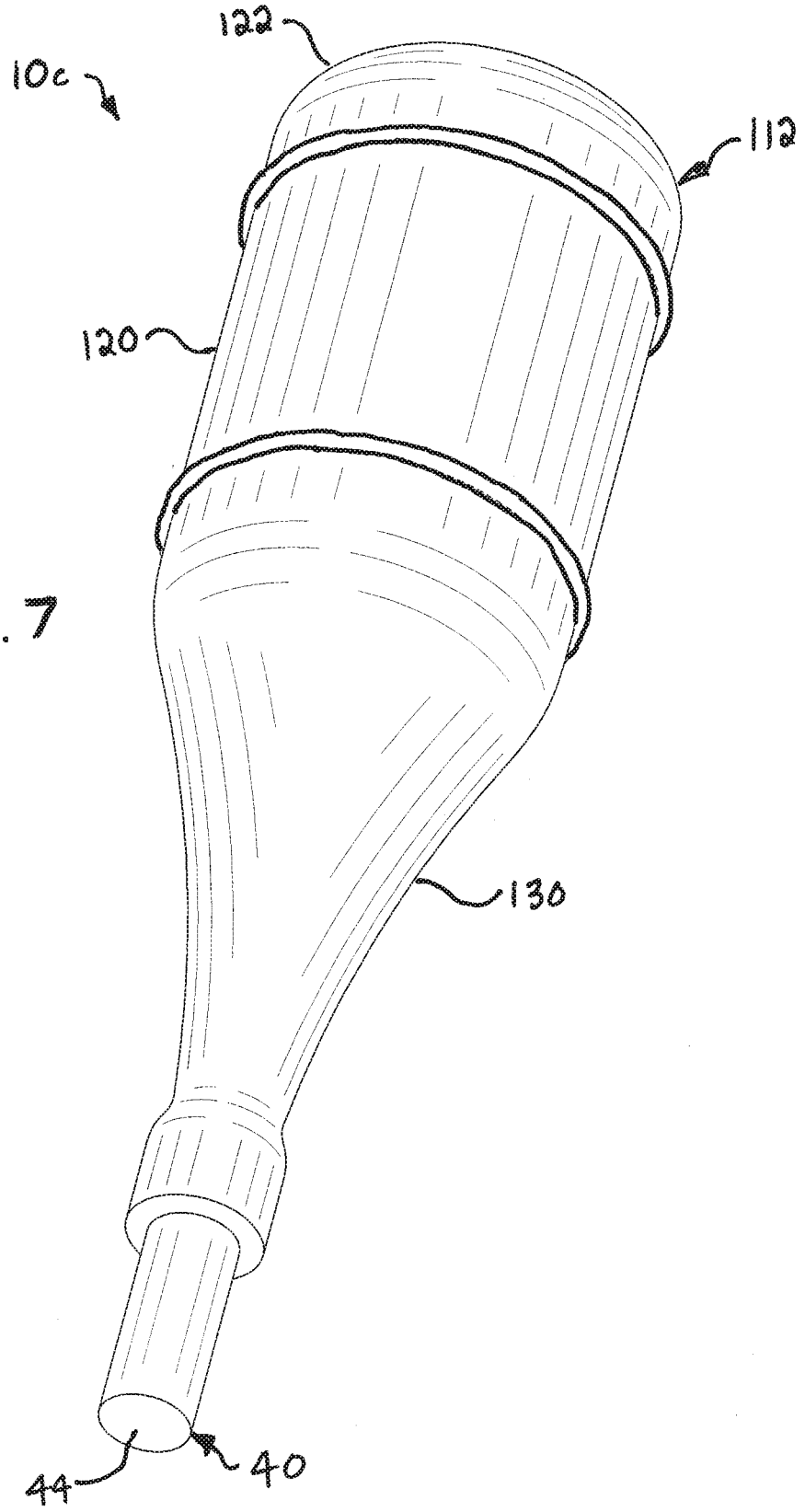
FIG. 7 is a top, front perspective view of the wine and spirits aerator of FIG. 6.
Figure 8:
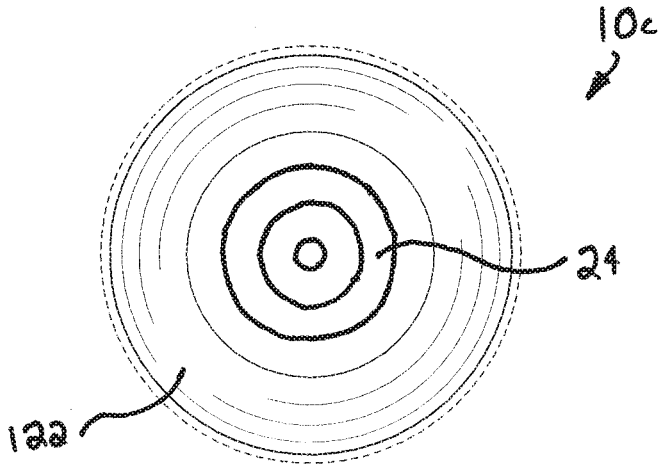
FIG. 8 is a bottom view of the wine and spirits aerator of FIG. 6.
Figure 9:
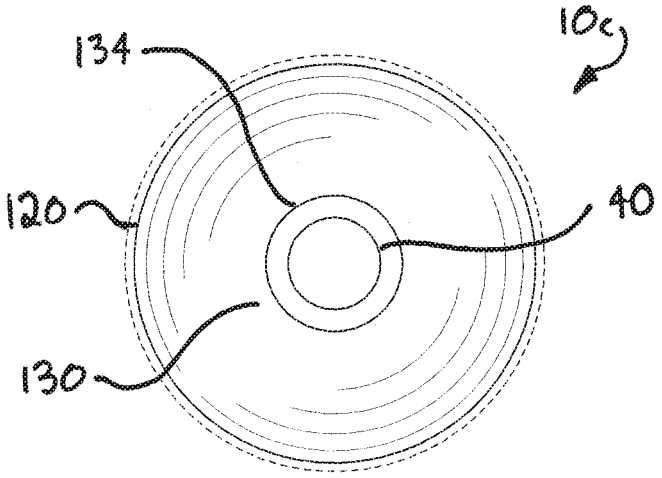
FIG. 9 is a top view of the wine and spirits aerator of FIG. 6.
Figure 10:
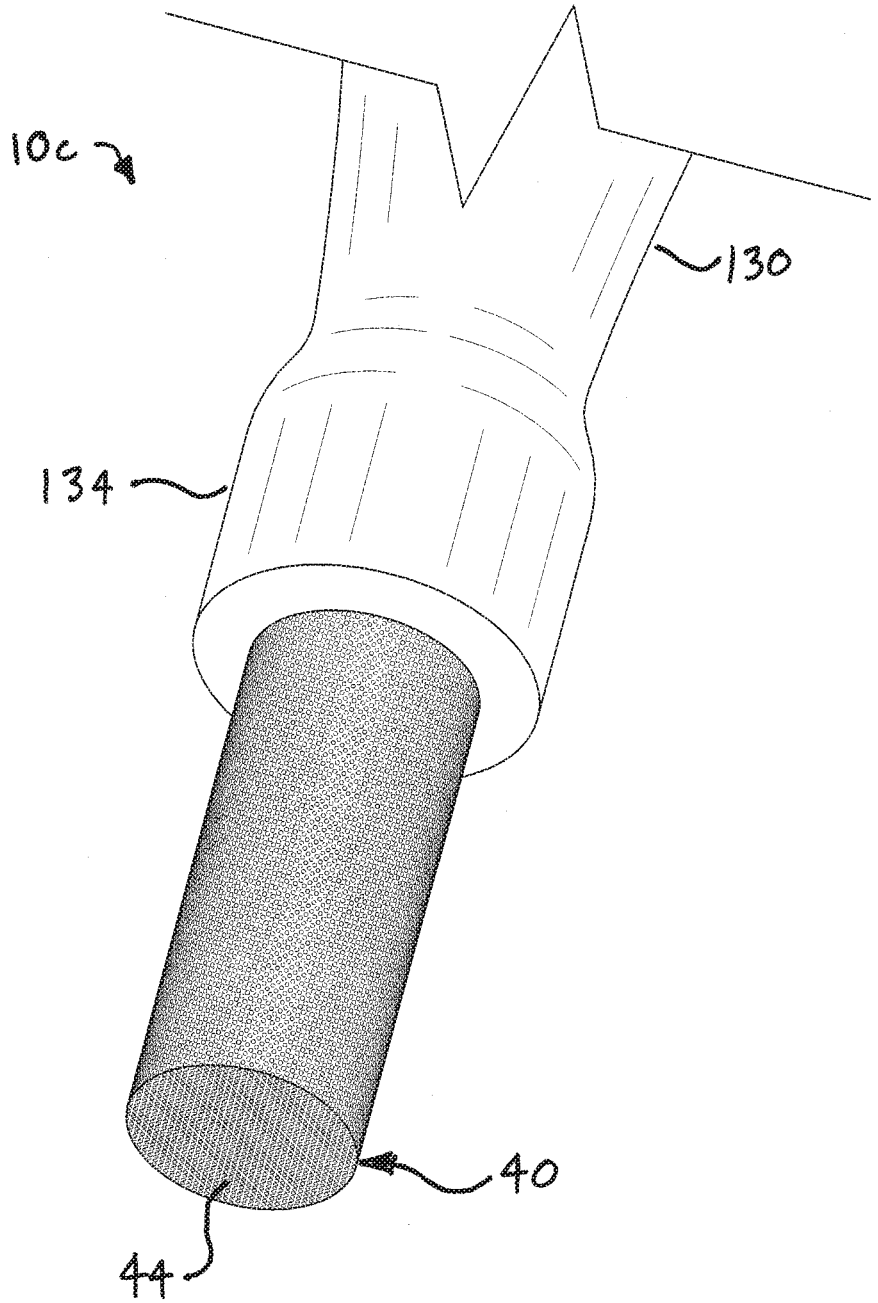
FIG. 10 is an enlarged, sectioned view of the wine and spirits aerator of FIG. 6.

Base pump portion 120 of air deliverer 112 at its front end 126 transitions to neck portion 130, which in an embodiment is a smooth radius transition. Neck portion 130 may be a hollow cylinder having an at least substantially constant diameter (narrower than diameter of base portion 120) from its proximal end 132 to its distal end 134. Neck portion 130 may alternatively be tapered, e.g., narrowed from its proximal end 132 to its distal end 134 as illustrated in FIGS. 6 and 7.

Diffuser 40 may be removeably press-fitted into, press-fitted onto, threaded onto, threaded into, compression fitted to, adhered to, and/or formed integrally with or permanently attached to distal end 134 of neck portion 130 of air deliverer 112. In the illustrated embodiment of FIGS. 6, 7, 9 and 10, distal end 134 of neck portion 130 of air deliverer 112 is sealingly stretched to fit around an open end of diffuser 40. A distal end 44 of diffuser 40 is closed with its porous material. Diffuser 40 in one embodiment is at least substantially cylindrical and includes an outer diameter that is greater than an inner diameter of distal end 134 of neck portion 130. Thus, the distal end 134 of neck portion 130 has to stretch and thereby seal to an open end of diffuser 40 to be connected removeably to same.

Diffuser 10*c* may include an integral internal step at the distal end of the stem or neck portion to catch diffuser 40 as it is inserted into the stem or neck portion. The internal step may be the same as or like internal step 36 of FIGS. 3A and 3B, which may molded with the air deliverer. The internal step stops diffuser 40 at a desired location when diffuser 40 is inserted into distal end 134 of neck portion 130. That is, the open end of diffuser 40 abuts up against the step when diffuser 40 is fully inserted into distal end 134 of stem portion 130.

It should be understood that various changes and modifications to the presently preferred embodiments described herein will be apparent to those skilled in the art. Such changes and modifications may be made without departing from the spirit and scope of the present subject matter and without diminishing its intended advantages. It is therefore intended that such changes and modifications be covered by the appended claims.

The invention is claimed as follows:

1. A liquid aerator comprising:

an air deliverer including a bulb pump portion formed integrally with a stem portion;

a one-way valve located in the bulb pump portion of the air deliverer; and a porous diffuser located at a distal end of the stem portion of the air deliverer, wherein the distal end of the stem portion stretches around an open end of the diffuser to seal to the diffuser.

2. The liquid aerator of claim 1, wherein the diffuser is removeably connected to the distal end of the stem portion of the air deliverer.

3. The liquid aerator of claim 1, wherein the bulb pump portion and the stem portion are molded as one piece.

4. The liquid aerator of claim 1, wherein the diffuser has a pore size of one-hundred microns or less.

5. The liquid aerator of claim 1, wherein the distal end of the stem portion of the air deliverer seals onto the porous diffuser.

6. The liquid aerator of claim 1, wherein the stem portion is tapered.

7. The liquid aerator of claim 1, wherein the stem portion is at least substantially cylindrical.

8. The liquid aerator of claim 1, wherein the air deliverer is rubber or plastic.

9. The liquid aerator of claim 1, wherein the diffuser is sintered metal.

10. The liquid aerator of claim 1, wherein the diffuser is cylindrical and the distal end of the stem portion stretches around an open end of the cylindrical diffuser to seal to the diffuser.

11. The liquid aerator of claim 1, wherein the bulb portion of the air deliverer is oblong in cross-section.

12. The liquid aerator of claim 1, wherein the bulb portion of the air deliverer is at least substantially circular in cross-section.

13. The liquid aerator of claim 1, wherein the bulb portion of the air deliverer is cylindrical and has a diameter that is larger than a diameter of the stem portion.

14. The liquid aerator of claim 1, wherein the bulb portion of the air deliverer has an end configured to enable the liquid aerator to be set on and supported by the end so that the stem portion extends upwardly without additional support.

15. The liquid aerator of claim 1, wherein an inner diameter of the distal end of the stem portion of the air deliverer defines a step against which the diffuser is abutted when fully inserted into the distal end.

16. The liquid aerator of claim 15, wherein the inner diameter of the distal end of the stem portion of the air deliverer is smaller than an outer diameter of the diffuser.

17. A liquid aerator comprising:

an air deliverer having a bottle shape including a larger diameter base portion molded as one piece with a narrower diameter neck portion;

a one-way valve located in the base portion of the air deliverer;

a porous diffuser located at a distal end of the neck portion of the air deliverer; and wherein an inner diameter of the distal end of the neck portion of the air deliverer defines a step against which the porous diffuser is abutted when fully inserted into the distal end.

18. The liquid aerator of claim 17, wherein the base portion of the bottle-shaped air deliverer has an end configured to enable the liquid aerator to be set on and supported by the end so that the neck portion extends upwardly without additional support.

19. The liquid aerator of claim 17, wherein the air deliverer is rubber or plastic.

20. A liquid aerator comprising:

an air deliverer including a bulb pump portion formed integrally with a stem portion;

a one-way valve located in the bulb pump portion of the air deliverer;

a porous diffuser located at a distal end of the stem portion of the air deliverer; and wherein an inner diameter of the distal end of the stem portion of the air deliverer defines a step against which the porous diffuser is abutted when fully inserted into the distal end.

21. The liquid aerator of claim 20, wherein the inner diameter of the distal end of the stem portion of the air deliverer is smaller than an outer diameter of the diffuser.

* * * * *